United States Patent [19]

Matsuura et al.

[11] 3,999,159

[45] Dec. 21, 1976

[54] VOLTAGE-DEPENDENT RESISTOR

[75] Inventors: Mikio Matsuura; Nobuji Nishi, both of Hirakata; Michio Matsuoka, Ibaragi; Takeshi Masuyama, Takatsuki, all of Japan

[73] Assignee: Matsushita Electric Industrial Co., Ltd., Japan

[22] Filed: Apr. 2, 1975

[21] Appl. No.: 564,628

[30] Foreign Application Priority Data

Apr. 5, 1974 Japan ..... 49-39099

[52] U.S. Cl. ..... 338/21; 252/518

[51] Int. Cl.[2] ..... H01C 7/12

[58] Field of Search ..... 338/20, 21; 252/518–520

[56] References Cited

UNITED STATES PATENTS

| | | | |
|---|---|---|---|
| 3,611,073 | 10/1971 | Hamamoto | 338/20 X |
| 3,682,841 | 8/1972 | Matsuoka et al. | 252/518 |
| 3,760,318 | 9/1973 | Masuyama | 338/20 |
| 3,806,765 | 4/1974 | Matsuoka et al. | 338/21 |
| 3,863,193 | 1/1975 | Matsuura et al. | 338/21 X |

*Primary Examiner*—C. L. Albritton

*Attorney, Agent, or Firm*—Wenderoth, Lind & Ponack

[57] ABSTRACT

A voltage-dependent resistor comprising a sintered body consisting essentially of ZnO, as a main constituent, and, as additives, bismuth oxide ($Bi_2O_3$), cobalt oxide (CoO) and/or manganese oxide (MnO) and/or aluminum oxide ($Al_2O_3$) and gallium oxide ($Ga_2O_3$) and/or indium oxide ($In_2O_3$) with electrodes applied to the opposite surfaces of the sintered body. This voltage-dependent resistor has a low C-value, a high n-value, high power dissipation for surge energy and a high stability to a high D.C. load. Other additives such as titanium oxide ($TiO_2$), chromium oxide ($Cr_2O_3$) and nickel oxide (NiO) improve the voltage dependent property of the sintered body.

6 Claims, 1 Drawing Figure

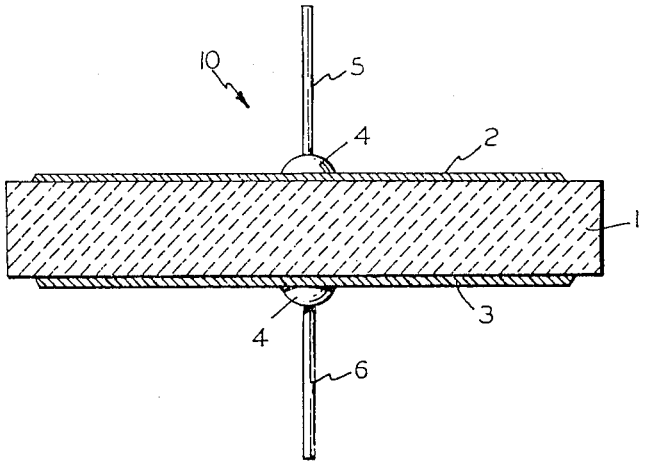
10
5
4
2
1
3
4
6

VOLTAGE-DEPENDENT RESISTOR

This invention relates to a voltage-dependent resistor (varistor) having non-ohmic properties (voltage-dependent properties) due to the bulk thereof and more particularly to a voltage-dependent resistor, which is suitable for a surge absorber and a D.C. stabilizer.

Various voltage-dependent resistors such as silicon carbide voltage-dependent resistors, selenium rectifiers and germanium or silicon p-n junction diodes have been widely used for stabilization of voltage of electrical circuits or suppression of abnormally high surge induced in electrical circuits. The electrical characteristics of such voltage-dependent resistors are expressed by the relation:

$$I=(V/C)^n \qquad (1)$$

where $V$ is the voltage across the resistor, $I$ is the current flowing through the resistor, $C$ is a constant corresponding to the voltage at a given current and exponent $n$ is a numerical value greater than 1. The value of $n$ is calculated by the following equation:

$$n = \frac{\log_{10}(I_2/I_1)}{\log_{10}(V_2/V_1)}$$

where $V_1$ and $V_2$ are the voltage at given currents $I_1$ and $I_2$, respectively. The desired value of C depends upon the kind of application to which the resistor is to be put. It is ordinarily desirable that the value of $n$ be as large as possible since this exponent determines the extent to which the resistors depart from ohmic characteristics. Conveniently, the $n$-value, as defined by $I_1$, $I_2$, $V_1$ and $V_2$ as shown in equation (2) is expressed by ${}_1n_2$, to distinguish from the $n$-value calculated by other currents or voltages.

Voltage-dependent resistors comprising sintered bodies of zinc oxide with or without additives and non-ohmic electrode applied thereto, have already been disclosed as seen in U.S. Pat. Nos. 3,496,512; 3,570,002; 3,503,029; 3,689,863 and 3,766,098. The nonlinearity (voltage-dependent property) of such voltage-dependent resistors is attributed to the interface between the sintered body of zinc oxide with or without additives and a silver paint electrode, and is controlled mainly by changing the compositions of the sintered body and the silver paint electrode. Therefore, it is not easy to control the C-Value over a wide range after the sintered body is prepared. Similarly, in voltage-dependent resistors comprising germanium or silicon p-n junction diodes, it is difficult to control the C-value over a wide range because the nonlinearity of these voltage-dependent resistors is not attributed to their bulk but rather to their p-n junction. In addition, it is almost impossible for those zinc oxide voltage-dependent resistors mentioned above and germanium or silicon diode voltage-dependent resistors have a combination of a C-value higher than 100 volts, an $n$-value higher than 10 and high surge resistance tolerable for a surge of more than 100A.

On the other hand, the silicon carbide voltage-dependent resistors have nonlinearity due to the contacts among the individual grains of silicon carbide bonded together by a ceramic binding material, i.e. to the bulk, and the C-value is controlled by changing a dimension in the direction in which the current flows through the voltage-dependent resistors. In addition, the silicon carbide voltage-dependent resistors have high surge resistance thus rendering them suitable e.g. as surge absorbers. The silicon carbide varistors, however, have a relatively low $n$-value ranging from 3 to 7 which results in poor surge suppression as well as poor D.C. stabilization. Another defect of the silicon carbide voltage-dependent resistors as a D.C. stabilizer is large change rate in the C-value and the $n$-value during the D.C. load life test.

There have been known, on the other hand, voltage-dependent resistors of the bulk type comprising a sintered body of zinc oxide with additives, as seen in U.S. Pat. Nos. 3,633,458; 3,632,529; 3,634,337; 3,598,763; 3,682,841; 3,642,664; 3,658,725; 3,687,871; 3,723,175; 3,778,743; 3,806,765; 3,811,103; and copending U.S. Patent application Ser. Nos. 29,416; 388,169; 428,737, and 489,827. These zinc oxide voltage-dependent resistors of the bulk type contain, as additives, one or more combinations of oxides or fluorides of bismuth, cobalt, manganese, barium, boron, berylium, magnesium, calcium, strontium, titanium, antimony, germanium, chromium and nickel, and the C-value is controllable by changing, mainly, the compositions of said sintered body and the distance between electrodes and they have an excellent voltage-dependent properties and $n$-value in a region of current less than 10A/cm$^2$. For a current higher than 10A/cm$^2$, however, the $n$-value goes down to a value lower than 10. This defect of these zinc oxide voltage-dependent resistors of the bulk type is presumably due mainly to their low $n$-value for the lower C-value, especially less than 80 volts. In general, these zinc oxide voltage-dependent resistors of the bulk type, mentioned above, have a very low $n$-value i.e. less than 20, when the C-value is lower than 80 volts. The power dissipation for surge energy, however, shows a relatively low value as compared with that of the conventional silicon carbide voltage-dependent resistor, so that the change rate of C-value exceeds e.g. 20 percent after two standard surges of 8×20 $\mu$sec wave form in a peak current of 500A/cm$^2$ are applied to the zinc oxide voltage-dependent resistors of bulk type. Another defect of these zinc oxide voltage-dependent resistors of bulk type is a poor stability to D.C. load, particularly their remarkable decreases of C-value measured even in a current region such as 10mA after applying a high D.C. power to the voltage-dependent resistors especially when they have a C-value less than 80 volts. This deterioration in C-value, especially less than 80 volts, is unfavorable e.g. for a voltage stabilizer which requires high accuracy and low loss for low voltage circuits. The defects of these zinc oxide voltage-dependent resistors of the bulk type are presumably mainly due to their low $n$-value for the lower C-value, especially of less than 80 volts. The development of the voltage-dependent resistors having a C-value e.g. less than 80 volts have been required for the application in low voltage circuits, such as in the automobile industry and home appliances, but the $n$-value of a conventional voltage-dependent resistors having a lower C-value is too small for uses such as voltage stabilizers and surge absorbers. For these reasons, voltage-dependent resistors of this type having a C-value less than 80 volts, have been used infrequently in the low voltage application.

An object of this invention is to provide a voltage-dependent resistor having a low C-value of less than 80 volts, a high *n*-value even in a region of current between 10A/cm$^2$ and 100A/cm$^2$, a high power dissipation for surge energy and high stability for a high D.C. load.

This and other objects of this invention will become apparent upon consideration of the following detailed description taken together with the accompanying drawing in which the single FIGURE is a cross-sectional view of a voltage dependent resistor in accordance with this invention.

Before proceeding with a detailed description of the manufacturing process of the voltage-dependent resistor contemplated by this invention, its construction will be described with reference to the single FIGURE wherein reference numeral 10 designates, as a whole, a voltage-dependent resistor comprising, as its active element, a sintered body having a pair of electrodes 2 and 3 in an ohmic contact with opposite surfaces thereof. The sintered body 1 is prepared in a manner hereinafter set forth and is any form such as circular, square or rectangular plate form. Wire leads 5 and 6 are attached conductively to the electrodes 2 and 3, respectively, by a connecting means 4 such as solder or the like.

It has been discovered according to the invention that a voltage-dependent resistor comprising a sintered body of a composition comprises, as additives, 0.1 to 5.0 mole percent of bismuth oxide ($Bi_2O_3$), at least one member selected from the group consisting of 0.1 to 3.0 mole percent of cobalt oxide (CoO) and 0.1 to 3.0 mole percent of manganese oxide (MnO) and 0.01 to 5.0 mole percent of gallium oxide ($Ga_2O_3$) and the remainder of zinc oxide (ZnO), as a main constituent, and of a composition which comprises, as additives, 0.1 to 5.0 mole percent of bismuth oxide ($Bi_2O_3$), at least one member selected from the group consisting of 0.1 to 3.0 mole percent of cobalt oxide (CoO) and 0.1 to 3.0 mole percent of manganese oxide (MnO), 0.01 to 5.0 mole percent of gallium oxide ($Ga_2O_3$), 0.01 to 5.0 mole percent of aluminum oxide ($Al_2O_3$) and/or 0.01 to 5.0 mole percent of indium oxide ($In_2O_3$), and the remainder being zinc oxide (ZnO), as a main constituent; and electrodes applied to opposite surfaces of the sintered body, have a non-ohmic property (voltage-dependent property) due to the bulk of the resistor itself. Therefore, its C-value can be changed without impairing the *n*-value by changing the distance between the electrodes at opposite surfaces. According to this invention, the voltage-dependent resistor has a low C-value and, a high *n*-value even at a current region of between 10A/cm$^2$ and 100A/cm$^2$.

According to this invention, stability with respect to high surge impulse and high D.C. load, and the higher *n*-value with a low C-value, e.g. less than 80 volts, can be obtained when the zinc oxide ($Z_nO$) sintered body comprises, as additives, 0.1 to 5.0 mole percent of bismuth oxide ($Bi_2O_3$), at least one member selected from the group consisting of 0.1 to 3.0 mole percent of cobalt oxide (CoO) and 0.1 to 3.0 mole percent of manganese oxide (MnO) and 0.01 to 5.0 mole percent of gallium oxide ($Ga_2O_3$) and 0.1 to 3.0 mole percent of titanium oxide ($TiO_2$), and when the composition comprises, as additives, 0.1 to 5.0 mole percent of bismuth oxide ($Bi_2O_3$), at least one member selected from the group consisting of 0.1 to 3.0 mole percent of cobalt oxide (CoO) and 0.1 to 3.0 mole percent of manganese oxide (MnO), 0.01 to 5.0 mole percent of gallium oxide ($Ga_2O_3$), 0.01 to 5.0 mole percent of aluminum oxide ($Al_2O_3$) and/or 0.01 to 5.0 mole percent of indium oxide ($In_2O_3$) and 0.1 to 3.0 mole percent of titanium oxide ($TiO_2$), and the remainder being zinc oxide (ZnO), as a main constituent.

According to this invention, stability for a high D.C. load and a surge power can be further improved when the zinc oxide (ZnO) sintered body comprises, as additives, 0.1 to 5.0 mole percent of bismuth oxide ($Bi_2O_3$), 0.1 to 3.0 mole percent of cobalt oxide (CoO), 0.1 to 3.0 mole percent of manganese oxide (MnO), 0.01 to 5.0 mole percent of gallium oxide ($Ga_2O_3$), at least one member selected from the group consisting of 0.1 to 5.0 mole percent of nickel oxide (NiO) and 0.01 to 5.0 mole percent of chromium oxide ($Cr_2O_3$) and 0.1 to 3.0 mole percent of titanium oxide ($TiO_2$), and when the composition comprises, as additives, 0.1 to 5.0 mole percent of bismuth oxide ($Bi_2O_3$), at least one member selected from the group consisting of 0.1 to 3.0 mole percent of cobalt oxide (CoO) and 0.1 to 3.0 mole percent of manganese oxide (MnO), 0.01 to 5.0 mole percent of gallium oxide ($Ga_2O_3$), 0.01 to 5.0 mole percent of aluminum oxide ($Al_2O_3$) and/or 0.01 to 5.0 mole percent of indium oxide ($In_2O_3$), 0.1 to 3.0 mole percent of titanium oxide ($TiO_2$) and at least one member selected from the group consisting of 0.1 to 5.0 mole percent of nickel oxide and 0.01 to 5.0 mole percent of chromium oxide ($Cr_2O_3$), and the remainder being zinc oxide (ZnO), as a main constituent.

The sintered body 1 can be prepared by per se well known ceramic technique. The starting materials in the compositions in the foregoing description are mixed in a wet mill so as to produce homogeneous mixtures. The mixtures are dried and pressed in a mold into desired shapes at a pressure from 50 kg./cm$^2$ to 500 kg/cm$^2$. The pressed bodies are sintered in air at 1000° C to 1450° C for 1 to 20 hours, and then furnace-cooled to room temperature (about 15° C to about 30° C). The mixture can be preliminarily calcined at 600° to 1000° C and pulverized for easy fabrication in a subsequent pressing step. The mixture to be pressed can be admixed with a suitable binder such as water, polyvinyl alcohol, etc. It is advantageous that the sintered body is lapped at the opposite surfaces by abrasive powder such as silicon carbide with a particle size of about 10 to 50$\mu$ in mean diameter. The sintered bodies are provided, at the opposite surfaces thereof, with electrodes by any available and suitable method such as silver painting, vacuum evaporation or flame spraying of metal such as Al, Zn, Sn, etc.

The voltage-dependent properties are not affected by, in a practical way, the kind of electrodes used, but are affected by the thickness of the sintered bodies. Particularly, the C-value varies in proportion to the thickness of the sintered bodies, while the *n*-value is almost independent of the thickness. This surely means that the voltage-dependent property is due to the bulk itself, but not to the electrodes.

Lead wires can be attached to the electrodes in a per se conventional manner by using conventional solder. It is convenient to employ a conductive adhesive comprising silver powder and resin in an organic solvent in order to connect the lead wires to the electrodes. Voltage-dependent resistors according to this invention have a high stability in a surge test which is carried out by applying a surge wave having a form of 8×20 $\mu$sec and more than 500A/cm$^2$. The *n*-value does not change significantly after the heating cycles, a load life test, a humidity test and a surge life test. It is advantageous for achievement of high stability with respect to humidity that the resultant voltage-dependent resistors is embedded in a humidity proof resin such as epoxy resin and phenol resin in a per se well known manner.

The following examples are meant to illustrate preferred embodiments of this invention, but not meant to limit the scope thereof.

EXAMPLE 1

Zinc oxide and additives as shown in Table 1 were mixed in a wet mill for 24 hours. The mixture was dried and pressed in a mold into discs of 13.5 mm in diameter and 7 mm in thickness at a pressure of 250 kg/cm$^2$.

The pressed bodies were sintered in air under the condition shown in Table 1, and then were furnace-cooled to room temperature. The sintered bodies were lapped at the opposite surfaces thereof into a thickness shown in Table 1 by silicon carbide abrasive having a particle size of 30$\mu$ in mean diameter. The opposite surfaces of the sintered body were provided with a spray metallized film of aluminum by a per se well known technique.

The electrical characteristics of the resultant sintered bodies are shown in Table 1, which shows that the C-value varies approximately in proportion to the thickness of the sintered body while the values of $n_1$ and $n_2$ are the $n$-value defined between 0.1mA and 1mA and between 10A and 100A, respectively, and the $n$-values are essentially independent of the thickness. It will be readily recognized that the voltage-dependent property of the sintered body is attributed to the sintered body itself.

EXAMPLE 2

Zinc oxide and additives as shown in Table 2 were fabricated into voltage-dependent resistors by the same method as that of Example 1, except that the sintering condition in this Example 2 was at 1350° C for 1 hour. The electrical characteristics of the resultant resistors are shown in Table 2. The thickness is 1 mm. The change rate of C- and $n$-values after an impulse test and a D.C. load life test are shown in Table 2. The impulse Test was carried out by applying 10$^5$ impulses of 8×20 $\mu$sec, 500A, and the D.C. load life test was carried out by applying a D.C. load of 2 watt at 70° C ambient temperature for 1000 hours. It can be easily understood that the further addition of titanium oxide shows the higher $n$-value, a low C-value and the small change rates of both the C- and $n$-value after an impulse and a D.C. load life tests.

EXAMPLE 3

Zinc oxide and additives of Table 3 were fabricated into voltage-dependent resistors by the same process as that of Example 1, except the sintering condition was 1350° C for 1 hour. The electrical characteristics of the resulting resistors are shown in Table 3. The change rates of C- and $n$-value after an impulse test and after a D.C. load life test carried out by the same methods as those of Example 2, except that impulse repeated times in this Example 3 were 10$^6$ times are shown in Table 3. It will be easily understood that the combined addition of bismuth oxide, cobalt oxide, manganese oxide, titanium oxide, nickel fluoride and one member selected from the group consisting of chromium oxide and nickel oxide, or at least one member selected from the group consisting of nickel oxide and chromium oxide results in a high $n$-value, a smaller change rate in the C-value and a smaller change rate in the $n$-value and a lower C-value as compared with the above mentioned U.S. patents and Example 2. A positive change rate of $n$-value means that the voltage-dependent property is improved after testing and its reliability is increased for low voltage application.

EXAMPLE 4

The resistors of Examples 1, 2 and 3 were tested in accordance with a method widely used in testing electronic component parts. A heating cycle test was carried out by repeating 5 times the cycle in which the resistors are kept at 85° C ambient temperature for 30 minutes, cooled rapidly to −20° C and then kept at such temperature for 30 minutes. A humidity test was carried out at 40° C and 95% relative humidity for 1000 hours. Table 8 shows the average change rates of the C-value and $n$-value of the resistors after the heating cycle test and the humidity test. It is easily understood that each sample has a small change rate.

Table 1

| Additives (mole %) | | | | | | Sintering condition | | | Characteristics of Resultant Resistor | | |
|---|---|---|---|---|---|---|---|---|---|---|---|
| $Bi_2O_3$ | CoO | MnO | $Al_2O_3$ | $Ga_2O_3$ | $In_2O_3$ | Temp. (° C) | Temp. (hrs) | Thickness (mm) | C (V) at 10mA | $n_1$ | $n_2$ |
| 0.1 | 0.1 | — | — | 0.01 | — | 1000 | 10 | 1 | 24 | 6 | 10 |
| 0.1 | 0.1 | — | — | 5.0 | — | 1200 | 5 | 1 | 38 | 7 | 10 |
| 0.1 | 3.0 | — | — | 0.01 | — | 1300 | 2 | 1 | 45 | 7 | 11 |
| 5.0 | 3.0 | — | — | 5.0 | — | 1450 | 1 | 1 | 70 | 8 | 10 |
| 5.0 | 0.1 | — | — | 0.01 | — | 1300 | 1 | 1 | 58 | 7 | 10 |
| 5.0 | 0.1 | — | — | 5.0 | — | 1450 | 1 | 1 | 42 | 7 | 10 |
| 0.5 | 3.0 | — | — | 0.01 | — | 1300 | 5 | 1 | 35 | 7 | 10 |
| 0.5 | 3.0 | — | — | 5.0 | — | 1250 | 10 | 1 | 57 | 8 | 11 |
| 0.5 | 0.5 | — | — | 0.5 | — | 1350 | 1 | initial(5) | 112 | 7 | 10 |
| 0.5 | 0.5 | — | — | 0.5 | — | 1350 | 1 | 3 | 65 | 9 | 10 |
| 0.5 | 0.5 | — | — | 0.5 | — | 1350 | 1 | 1 | 22 | 9 | 10 |
| 0.1 | — | 0.1 | — | 0.01 | — | 1000 | 10 | 1 | 15 | 7 | 11 |
| 0.1 | — | 0.1 | — | 5.0 | — | 1200 | 5 | 1 | 27 | 8 | 12 |
| 5.0 | — | 3.0 | — | 0.01 | — | 1450 | 1 | 1 | 38 | 8 | 12 |
| 5.0 | — | 3.0 | — | 5.0 | — | 1450 | 1 | 1 | 55 | 8 | 11 |
| 0.5 | — | 0.5 | — | 0.5 | — | 1350 | 1 | initial(5) | 134 | 9 | 12 |
| 0.5 | — | 0.5 | — | 0.5 | — | 1350 | 1 | 3 | 81 | 9 | 12 |
| 0.5 | — | 0.5 | — | 0.5 | — | 1350 | 1 | 1 | 27 | 9 | 12 |
| 0.1 | 0.1 | 0.1 | — | 0.01 | — | 1000 | 10 | 1 | 12 | 6 | 10 |
| 0.1 | 0.1 | 0.1 | — | 5.0 | — | 1200 | 5 | 1 | 25 | 7 | 10 |
| 5.0 | 3.0 | 3.0 | — | 0.01 | — | 1450 | 1 | 1 | 49 | 7 | 11 |
| 5.0 | 3.0 | 3.0 | — | 5.0 | — | 1450 | 1 | 1 | 74 | 7 | 11 |
| 0.5 | 0.5 | 0.5 | — | 0.5 | — | 1350 | 1 | initial(5) | 132 | 6 | 10 |
| 0.5 | 0.5 | 0.5 | — | 0.5 | — | 1350 | 1 | 3 | 78 | 6 | 10 |

Table 1-continued

| | | Additives (mole %) | | | | Sintering condition | | | Characteristics of Resultant Resistor | | |
|---|---|---|---|---|---|---|---|---|---|---|---|
| $Bi_2O_3$ | CoO | MnO | $Al_2O_3$ | $Ga_2O_3$ | $In_2O_3$ | Temp. (° C) | Temp. (hrs) | Thickness (mm) | C (V) at 10mA | $n_1$ | $n_2$ |
| 0.5 | 0.5 | 0.5 | — | 0.5 | — | 1350 | 1 | 1 | 26 | 6 | 10 |
| 0.1 | 0.1 | — | 0.01 | 0.01 | — | 1000 | 10 | 1 | 18 | 7 | 13 |
| 0.1 | 0.1 | — | 5.0 | 5.0 | — | 1200 | 5 | 1 | 25 | 7 | 13 |
| 0.1 | 3.0 | — | 0.01 | 0.01 | — | 1200 | 2 | 1 | 21 | 7 | 13 |
| 0.1 | 3.0 | — | 5.0 | 5.0 | — | 1300 | 1 | 1 | 25 | 7 | 14 |
| 5.0 | 0.1 | — | 0.01 | 0.01 | — | 1250 | 2 | 1 | 30 | 7 | 13 |
| 5.0 | 0.1 | — | 5.0 | 5.0 | — | 1350 | 1 | 1 | 38 | 8 | 14 |
| 5.0 | 3.0 | — | 0.01 | 0.01 | — | 1300 | 2 | 1 | 50 | 8 | 14 |
| 5.0 | 3.0 | — | 5.0 | 5.0 | — | 1400 | 1 | 1 | 67 | 8 | 14 |
| 0.5 | 0.5 | — | 0.5 | 0.5 | — | 1350 | 1 | initial(5) | 110 | 9 | 15 |
| 0.5 | 0.5 | — | 0.5 | 0.5 | — | 1350 | 1 | 3 | 67 | 9 | 15 |
| 0.5 | 0.5 | — | 0.5 | 0.5 | — | 1350 | 1 | 1 | 22 | 9 | 15 |
| 0.1 | — | 0.1 | 0.01 | 0.01 | — | 1000 | 10 | 1 | 12 | 7 | 10 |
| 0.1 | — | 0.1 | 5.0 | 5.0 | — | 1200 | 4 | 1 | 17 | 7 | 10 |
| 0.1 | — | 3.0 | 0.01 | 0.01 | — | 1200 | 3 | 1 | 26 | 8 | 11 |
| 0.1 | — | 3.0 | 5.0 | 5.0 | — | 1300 | 1 | 1 | 21 | 8 | 11 |
| 5.0 | — | 0.1 | 0.01 | 0.01 | — | 1250 | 2 | 1 | 33 | 7 | 10 |
| 5.0 | — | 0.1 | 5.0 | 5.0 | — | 1350 | 1 | 1 | 30 | 8 | 10 |
| 5.0 | — | 3.0 | 0.01 | 0.01 | — | 1300 | 2 | 1 | 42 | 8 | 10 |
| 5.0 | — | 3.0 | 5.0 | 5.0 | — | 1450 | 1 | 1 | 58 | 8 | 11 |
| 0.5 | — | 0.5 | 0.5 | 0.5 | — | 1350 | 1 | initial(5) | 85 | 9 | 13 |
| 0.5 | — | 0.5 | 0.5 | 0.5 | — | 1350 | 1 | 3 | 51 | 9 | 13 |
| 0.5 | — | 0.5 | 0.5 | 0.5 | — | 1350 | 1 | 1 | 17 | 9 | 13 |
| 0.1 | 0.1 | 0.1 | 0.01 | 0.01 | — | 1000 | 5 | 1 | 15 | 7 | 13 |
| 0.1 | 0.1 | 0.1 | 5.0 | 5.0 | — | 1200 | 5 | 1 | 17 | 7 | 13 |
| 0.1 | 3.0 | 3.0 | 0.01 | 0.01 | — | 1250 | 2 | 1 | 29 | 8 | 14 |
| 0.1 | 3.0 | 3.0 | 5.0 | 5.0 | — | 1300 | 2 | 1 | 32 | 8 | 13 |
| 5.0 | 0.1 | 3.0 | 0.01 | 0.01 | — | 1250 | 1 | 1 | 41 | 9 | 12 |
| 5.0 | 0.1 | 3.0 | 5.0 | 5.0 | — | 1350 | 1 | 1 | 43 | 8 | 12 |
| 5.0 | 3.0 | 3.0 | 0.01 | 0.01 | — | 1300 | 2 | 1 | 52 | 8 | 13 |
| 5.0 | 3.0 | 3.0 | 5.0 | 5.0 | — | 1450 | 1 | 1 | 60 | 8 | 14 |
| 0.5 | 0.5 | 0.5 | 0.5 | 0.5 | — | 1350 | 1 | initial(5) | 102 | 9 | 15 |
| 0.5 | 0.5 | 0.5 | 0.5 | 0.5 | — | 1350 | 1 | 3 | 60 | 9 | 15 |
| 0.5 | 0.5 | 0.5 | 0.5 | 0.5 | — | 1350 | 1 | 1 | 20 | 9 | 15 |
| 0.1 | 0.1 | — | — | 0.01 | 0.01 | 1000 | 10 | 1 | 11 | 6 | 10 |
| 0.1 | 0.1 | — | — | 5.0 | 5.0 | 1200 | 5 | 1 | 17 | 6 | 11 |
| 0.1 | 3.0 | — | — | 0.01 | 0.01 | 1200 | 2 | 1 | 24 | 7 | 10 |
| 0.1 | 3.0 | — | — | 5.0 | 5.0 | 1300 | 1 | 1 | 28 | 7 | 11 |
| 5.0 | 0.1 | — | — | 0.01 | 0.01 | 1250 | 2 | 1 | 32 | 7 | 10 |
| 5.0 | 0.1 | — | — | 5.0 | 5.0 | 1350 | 1 | 1 | 48 | 8 | 10 |
| 5.0 | 3.0 | — | — | 0.01 | 0.01 | 1200 | 2 | 1 | 57 | 8 | 11 |
| 5.0 | 3.0 | — | — | 5.0 | 5.0 | 1400 | 1 | 1 | 69 | 8 | 11 |
| 0.5 | 0.5 | — | — | 0.5 | 0.5 | 1350 | 1 | initial(5) | 92 | 9 | 13 |
| 0.5 | 0.5 | — | — | 0.5 | 0.5 | 1350 | 1 | 3 | 54 | 9 | 13 |
| 0.5 | 0.5 | — | — | 0.5 | 0.5 | 1350 | 1 | 1 | 18 | 9 | 13 |
| 0.1 | — | 0.1 | — | 0.01 | 0.01 | 1000 | 10 | 1 | 9 | 7 | 11 |
| 0.1 | — | 0.1 | — | 5.0 | 5.0 | 1200 | 4 | 1 | 15 | 7 | 12 |
| 0.1 | — | 3.0 | — | 0.01 | 0.01 | 1200 | 3 | 1 | 30 | 8 | 11 |
| 0.1 | — | 3.0 | — | 5.0 | 5.0 | 1300 | 1 | 1 | 38 | 7 | 11 |
| 5.0 | — | 0.1 | — | 0.01 | 0.01 | 1250 | 2 | 1 | 47 | 8 | 11 |
| 5.0 | — | 0.1 | — | 5.0 | 5.0 | 1350 | 1 | 1 | 54 | 9 | 12 |
| 5.0 | — | 3.0 | — | 0.01 | 0.01 | 1300 | 2 | 1 | 60 | 9 | 12 |
| 5.0 | — | 3.0 | — | 5.0 | 5.0 | 1450 | 1 | 1 | 69 | 9 | 13 |
| 0.5 | — | 0.5 | — | 0.5 | 0.5 | 1350 | 1 | initial(5) | 117 | 10 | 14 |
| 0.5 | — | 0.5 | — | 0.5 | 0.5 | 1350 | 1 | 3 | 70 | 10 | 14 |
| 0.5 | — | 0.5 | — | 0.5 | 0.5 | 1350 | 1 | 1 | 23 | 10 | 14 |
| 0.1 | 0.1 | 0.1 | — | 0.01 | 0.01 | 1000 | 5 | 1 | 13 | 7 | 11 |
| 0.1 | 0.1 | 0.1 | — | 5.0 | 5.0 | 1200 | 5 | 1 | 17 | 8 | 12 |
| 0.1 | 3.0 | 3.0 | — | 0.01 | 0.01 | 1250 | 2 | 1 | 37 | 8 | 12 |
| 0.1 | 3.0 | 3.0 | — | 5.0 | 5.0 | 1300 | 2 | 1 | 58 | 8 | 11 |
| 5.0 | 0.1 | 3.0 | — | 0.01 | 0.01 | 1250 | 1 | 1 | 48 | 8 | 11 |
| 5.0 | 0.1 | 3.0 | — | 5.0 | 5.0 | 1350 | 1 | 1 | 52 | 9 | 13 |
| 5.0 | 3.0 | 3.0 | — | 0.01 | 0.01 | 1300 | 2 | 1 | 62 | 9 | 13 |
| 5.0 | 3.0 | 3.0 | — | 5.0 | 5.0 | 1450 | 1 | 1 | 58 | 9 | 14 |
| 0.5 | 0.5 | 0.5 | — | 0.5 | 0.5 | 1350 | 1 | initial(5) | 97 | 10 | 15 |
| 0.5 | 0.5 | 0.5 | — | 0.5 | 0.5 | 1350 | 1 | 3 | 58 | 10 | 15 |
| 0.5 | 0.5 | 0.5 | — | 0.5 | 0.5 | 1350 | 1 | 1 | 19 | 10 | 15 |
| 0.1 | 0.1 | — | 0.01 | 0.01 | 0.01 | 1000 | 10 | 1 | 20 | 6 | 11 |
| 0.1 | 0.1 | — | 5.0 | 5.0 | 5.0 | 1200 | 5 | 1 | 27 | 7 | 12 |
| 0.1 | 3.0 | — | 0.01 | 0.01 | 0.01 | 1200 | 2 | 1 | 42 | 8 | 12 |
| 0.1 | 3.0 | — | 5.0 | 5.0 | 5.0 | 1300 | 1 | 1 | 50 | 7 | 11 |
| 5.0 | 0.1 | — | 0.01 | 0.01 | 0.01 | 1250 | 2 | 1 | 38 | 7 | 11 |
| 5.0 | 0.1 | — | 5.0 | 5.0 | 5.0 | 1350 | 1 | 1 | 47 | 7 | 12 |
| 5.0 | 3.0 | — | 0.01 | 0.01 | 0.01 | 1300 | 2 | 1 | 58 | 8 | 12 |
| 5.0 | 3.0 | — | 5.0 | 5.0 | 5.0 | 1400 | 1 | 1 | 72 | 7 | 12 |
| 0.5 | 0.5 | — | 0.5 | 0.5 | 0.5 | 1350 | 1 | initial(5) | 86 | 9 | 15 |
| 0.5 | 0.5 | — | 0.5 | 0.5 | 0.5 | 1350 | 1 | 3 | 52 | 9 | 15 |
| 0.5 | 0.5 | — | 0.5 | 0.5 | 0.5 | 1350 | 1 | 1 | 17 | 9 | 15 |
| 0.1 | — | 0.1 | 0.01 | 0.01 | 0.01 | 1000 | 10 | 1 | 18 | 6 | 10 |
| 0.1 | — | 0.1 | 5.0 | 5.0 | 5.0 | 1200 | 4 | 1 | 24 | 7 | 10 |
| 0.1 | — | 3.0 | 0.01 | 0.01 | 0.01 | 1200 | 3 | 1 | 33 | 7 | 11 |
| 0.1 | — | 3.0 | 5.0 | 5.0 | 5.0 | 1300 | 1 | 1 | 39 | 7 | 10 |
| 5.0 | — | 0.1 | 0.01 | 0.01 | 0.01 | 1250 | 2 | 1 | 47 | 7 | 10 |
| 5.0 | — | 0.1 | 5.0 | 5.0 | 5.0 | 1350 | 1 | 1 | 52 | 6 | 11 |
| 5.0 | — | 3.0 | 0.01 | 0.01 | 0.01 | 1300 | 2 | 1 | 59 | 6 | 12 |
| 5.0 | — | 3.0 | 5.0 | 5.0 | 5.0 | 1450 | 1 | 1 | 67 | 7 | 12 |
| 0.5 | — | 0.5 | 0.5 | 0.5 | 0.5 | 1350 | 1 | initial(5) | 99 | 8 | 13 |

Table 1-continued

| Additives (mole %) | | | | | | Sintering condition | | | Characteristics of Resultant Resistor | | |
|---|---|---|---|---|---|---|---|---|---|---|---|
| $Bi_2O_3$ | CoO | MnO | $Al_2O_3$ | $Ga_2O_3$ | $In_2O_3$ | Temp. (° C) | Temp. (hrs) | Thickness (mm) | C (V) at 10mA | $n_1$ | $n_2$ |
| 0.5 | — | 0.5 | 0.5 | 0.5 | 0.5 | 1350 | 1 | 3 | 58 | 8 | 13 |
| 0.5 | — | 0.5 | 0.5 | 0.5 | 0.5 | 1350 | 1 | 1 | 19 | 8 | 13 |
| 0.1 | 0.1 | 0.1 | 0.01 | 0.01 | 0.01 | 1000 | 5 | 1 | 10 | 7 | 11 |
| 0.1 | 0.1 | 0.1 | 5.0 | 5.0 | 5.0 | 1200 | 5 | 1 | 25 | 8 | 11 |
| 0.1 | 3.0 | 3.0 | 0.01 | 0.01 | 0.01 | 1250 | 2 | 1 | 24 | 8 | 11 |
| 0.1 | 3.0 | 3.0 | 5.0 | 5.0 | 5.0 | 1300 | 2 | 1 | 30 | 8 | 11 |
| 5.0 | 0.1 | 3.0 | 0.01 | 0.01 | 0.01 | 1250 | 1 | 1 | 42 | 7 | 13 |
| 5.0 | 0.1 | 3.0 | 5.0 | 5.0 | 5.0 | 1350 | 1 | 1 | 49 | 8 | 12 |
| 5.0 | 3.0 | 3.0 | 0.01 | 0.01 | 0.01 | 1300 | 2 | 1 | 47 | 8 | 13 |
| 5.0 | 3.0 | 3.0 | 5.0 | 5.0 | 5.0 | 1450 | 1 | 1 | 59 | 9 | 13 |
| 0.5 | 0.5 | 0.5 | 0.5 | 0.5 | 0.5 | 1350 | 1 | initial(5) | 182 | 9 | 15 |
| 0.5 | 0.5 | 0.5 | 0.5 | 0.5 | 0.5 | 1350 | 1 | 3 | 109 | 9 | 15 |
| 0.5 | 0.5 | 0.5 | 0.5 | 0.5 | 0.5 | 1350 | 1 | 1 | 36 | 9 | 15 |

Table 2

| Additives (mole %) | | | | | | | Characteristics of Resultant Resistor | | | Change Rate after Impulse Test(%) | | | Change Rate after D.C. Load Life Test(%) | | |
|---|---|---|---|---|---|---|---|---|---|---|---|---|---|---|---|
| $Bi_2O_3$ | CoO | MnO | $TiO_2$ | $Al_2O_3$ | $Ga_2O_3$ | $In_2O_3$ | C (V) at 10mA | $n_1$ | $n_2$ | ΔC at 1mA | $\Delta n_1$ | $\Delta n_2$ | ΔC at 10mA | $\Delta n_1$ | $\Delta n_2$ |
| 0.1 | 0.1 | — | 0.1 | — | 0.01 | — | 10 | 11 | 16 | +10 | −9.2 | −8.1 | −9.5 | −9.6 | −8.2 |
| 0.1 | 3.0 | — | 0.1 | — | 0.01 | — | 11 | 11 | 16 | +9.1 | −8.5 | −7.5 | −9.3 | −8.7 | −7.4 |
| 0.1 | 0.1 | — | 0.1 | — | 0.5 | — | 16 | 11 | 16 | +7.4 | −6.6 | −5.6 | −7.9 | −8.6 | −5.5 |
| 0.1 | 0.1 | — | 3.0 | — | 0.01 | — | 15 | 11 | 16 | +8.1 | −7.4 | −6.4 | −8.0 | −7.5 | −6.3 |
| 5.0 | 0.1 | — | 0.1 | — | 0.01 | — | 14 | 12 | 16 | +8.3 | −8.1 | −6.7 | −8.2 | −8.5 | −6.9 |
| 0.1 | 3.0 | — | 0.1 | — | 5.0 | — | 21 | 11 | 16 | +7.1 | −7.2 | −5.9 | −7.5 | −7.6 | −5.9 |
| 0.1 | 3.0 | — | 3.0 | — | 0.01 | — | 20 | 12 | 17 | +8.5 | −8.3 | −7.5 | −8.8 | −8.4 | −7.2 |
| 5.0 | 3.0 | — | 0.1 | — | 0.01 | — | 17 | 11 | 16 | +8.6 | −7.7 | −6.0 | −8.7 | −7.9 | −6.0 |
| 0.1 | 0.1 | — | 3.0 | — | 5.0 | — | 19 | 11 | 16 | +7.3 | −6.5 | −5.4 | −7.5 | −6.2 | −7.2 |
| 5.0 | 0.1 | — | 0.1 | — | 5.0 | — | 30 | 12 | 17 | +9.4 | −8.7 | −7.6 | −9.5 | −8.9 | −5.8 |
| 5.0 | 0.1 | — | 3.0 | — | 0.01 | — | 32 | 12 | 16 | +9.5 | −8.5 | −7.7 | −9.3 | −8.8 | −5.6 |
| 0.1 | 3.0 | — | 3.0 | — | 5.0 | — | 68 | 12 | 17 | +7.0 | −6.5 | −5.6 | −7.7 | −6.9 | −7.7 |
| 5.0 | 3.0 | — | 0.1 | — | 5.0 | — | 50 | 12 | 16 | +7.4 | −6.8 | −5.8 | −7.4 | −7.2 | −7.6 |
| 5.0 | 3.0 | — | 3.0 | — | 0.01 | — | 52 | 12 | 17 | +8.3 | −8.1 | −7.2 | −8.5 | −8.5 | −5.4 |
| 5.0 | 0.1 | — | 3.0 | — | 5.0 | — | 40 | 12 | 17 | +7.6 | −7.1 | −6.0 | −7.3 | −7.4 | −6.7 |
| 5.0 | 3.0 | — | 3.0 | — | 5.0 | — | 63 | 12 | 17 | +9.5 | −8.6 | −7.5 | −9.2 | −8.9 | −7.2 |
| 0.5 | 0.5 | — | 0.5 | — | 0.5 | — | 16 | 13 | 19 | +5.0 | −5.0 | −4.4 | −5.0 | −5.1 | −4.1 |
| 0.1 | — | 0.1 | 0.1 | — | 0.01 | — | 15 | 13 | 17 | −5.1 | −9.8 | −8.4 | −9.6 | −6.8 | −7.8 |
| 0.1 | — | 3.0 | 0.1 | — | 0.01 | — | 20 | 14 | 18 | −4.8 | −8.2 | −7.8 | −9.4 | −7.4 | −6.1 |
| 0.1 | — | 0.1 | 0.1 | — | 5.0 | — | 19 | 15 | 17 | −4.2 | −8.4 | −7.0 | −8.6 | −9.5 | −8.0 |
| 0.1 | — | 0.1 | 3.0 | — | 0.01 | — | 21 | 15 | 17 | −4.5 | −8.9 | −7.6 | −8.8 | −8.2 | −6.9 |
| 5.0 | — | 0.1 | 0.1 | — | 0.01 | — | 18 | 14 | 17 | −5.0 | −8.5 | −7.9 | −8.7 | −7.9 | −6.6 |
| 0.1 | — | 3.0 | 0.1 | — | 5.0 | — | 24 | 15 | 18 | −4.7 | −8.4 | −7.1 | −8.6 | −8.4 | −7.2 |
| 0.1 | — | 3.0 | 3.0 | — | 0.01 | — | 22 | 15 | 18 | −4.6 | −8.7 | −7.3 | −8.7 | −8.0 | −6.7 |
| 5.0 | — | 3.0 | 0.1 | — | 0.01 | — | 30 | 14 | 18 | −4.5 | −8.6 | −7.2 | −7.9 | −7.5 | −7.2 |
| 0.1 | — | 0.1 | 3.0 | — | 5.0 | — | 35 | 15 | 17 | −4.4 | −8.5 | 07.1 | −8.6 | −8.3 | −7.3 |
| 5.0 | — | 0.1 | 0.1 | — | 5.0 | — | 38 | 15 | 16 | −3.8 | −8.1 | −6.5 | −9.2 | −7.8 | −7.4 |
| 5.0 | — | 0.1 | 3.0 | — | 0.01 | — | 41 | 15 | 16 | −4.3 | −8.5 | −7.1 | −7.7 | −7.5 | −7.1 |
| 0.1 | — | 3.0 | 3.0 | — | 5.0 | — | 50 | 17 | 18 | −3.8 | −7.9 | −6.4 | −7.8 | −9.1 | −7.9 |
| 5.0 | — | 3.0 | 0.1 | — | 5.0 | — | 57 | 17 | 18 | −3.9 | −8.1 | −6.8 | −8.4 | −8.9 | −7.6 |
| 5.0 | — | 3.0 | 3.0 | — | 0.01 | — | 48 | 16 | 18 | −5.1 | −9.5 | −7.6 | −7.5 | −8.4 | −7.0 |
| 5.0 | — | 0.1 | 3.0 | — | 5.0 | — | 62 | 16 | 17 | −3.7 | −7.4 | −6.2 | −8.6 | −9.2 | −7.8 |
| 5.0 | — | 3.0 | 3.0 | — | 5.0 | — | 69 | 17 | 18 | −4.2 | −7.5 | −6.9 | −9.3 | −9.8 | −8.4 |
| 0.5 | — | 0.5 | 0.5 | — | 0.05 | — | 21 | 19 | 20 | −1.9 | −5.9 | −4.5 | −6.0 | −5.5 | −4.6 |
| 0.1 | 0.1 | 0.1 | 0.1 | — | 0.01 | — | 10 | 22 | 21 | +5.8 | −5.0 | −4.0 | −4.5 | −5.0 | −3.8 |
| 0.1 | 3.0 | 0.1 | 0.1 | — | 0.01 | — | 16 | 22 | 21 | +5.5 | −4.7 | −3.7 | −4.7 | −4.8 | −3.7 |
| 0.1 | 0.1 | 3.0 | 0.1 | — | 0.01 | — | 17 | 23 | 22 | +5.8 | −4.9 | −8.8 | −4.8 | −4.6 | −3.6 |
| 0.1 | 3.0 | 3.0 | 0.1 | — | 0.01 | — | 26 | 24 | 22 | +5.6 | −4.2 | −3.3 | −4.2 | −4.4 | −3.7 |
| 0.5 | 0.1 | 0.1 | 0.5 | — | 0.5 | — | 14 | 22 | 21 | +4.9 | −4.1 | −3.1 | −2.5 | −4.1 | −3.5 |
| 0.5 | 3.0 | 0.1 | 0.5 | — | 0.5 | — | 16 | 25 | 22 | +5.4 | −4.6 | −3.7 | −3.9 | −4.4 | −3.4 |
| 0.5 | 0.1 | 3.0 | 0.5 | — | 0.5 | — | 23 | 27 | 22 | +5.2 | −4.4 | −3.3 | −2.6 | −4.6 | −3.7 |
| 0.5 | 3.0 | 3.0 | 0.5 | — | 0.5 | — | 26 | 28 | 22 | +4.8 | −4.1 | −3.2 | −3.7 | −4.1 | −3.2 |
| 0.5 | 0.5 | 0.5 | 0.5 | — | 0.5 | — | 35 | 30 | 24 | +4.1 | −2.5 | −1.5 | −0.4 | −2.1 | −1.6 |
| 5.0 | 0.1 | 0.1 | 3.0 | — | 5.0 | — | 30 | 28 | 21 | +5.0 | −4.3 | −3.5 | −3.2 | −4.2 | −3.7 |
| 5.0 | 3.0 | 0.1 | 3.0 | — | 5.0 | — | 65 | 28 | 21 | +5.4 | −4.7 | −3.7 | −3.6 | −4.9 | −3.5 |
| 5.0 | 0.1 | 3.0 | 3.0 | — | 5.0 | — | 78 | 27 | 22 | +5.6 | −4.9 | −3.6 | −4.9 | −4.8 | −3.6 |
| 5.0 | 3.0 | 3.0 | 3.0 | — | 5.0 | — | 76 | 26 | 22 | +5.9 | −5.0 | −4.0 | −4.5 | −4.9 | −4.0 |
| 0.1 | 0.1 | — | 0.1 | 0.01 | 0.01 | — | 10 | 11 | 16 | +9.2 | −8.5 | −9.3 | −8.6 | −8.5 | −9.2 |
| 0.1 | 0.5 | — | 0.1 | 0.01 | 0.01 | — | 11 | 11 | 16 | +7.4 | −7.7 | −8.7 | −8.4 | −8.7 | −8.5 |
| 0.1 | 3.0 | — | 0.1 | 0.01 | 0.01 | — | 12 | 11 | 17 | +8.4 | −7.2 | −8.2 | −7.2 | −8.4 | −8.4 |
| 0.5 | 0.1 | — | 0.5 | 0.5 | 0.5 | — | 15 | 19 | 19 | +9.1 | −7.5 | −8.5 | −8.1 | −8.1 | −7.9 |
| 0.5 | 0.5 | ;13 | 0.5 | 0.5 | 0.5 | — | 19 | 17 | 16 | +8.5 | −4.8 | −4.5 | −5.2 | −5.0 | −4.2 |
| 0.5 | 3.0 | — | 0.5 | 0.5 | 0.5 | — | 28 | 17 | 17 | +5.4 | −6.5 | −7.3 | −7.3 | −7.8 | −7.1 |
| 5.0 | 0.1 | — | 3.0 | 5.0 | 5.0 | — | 36 | 18 | 16 | +8.3 | −8.4 | −8.5 | −7.1 | −7.4 | −7.4 |
| 5.0 | 0.5 | — | 3.0 | 5.0 | 5.0 | — | 45 | 15 | 17 | +7.7 | −8.6 | −9.7 | −8.5 | −8.3 | −7.5 |
| 5.0 | 3.0 | — | 3.0 | 5.0 | 5.0 | — | 59 | 14 | 17 | +8.9 | −8.1 | −9.2 | −9.3 | −8.5 | −8.6 |
| 0.1 | — | 0.1 | 0.1 | 0.01 | 0.01 | — | 7 | 11 | | −9.7 | −9.4 | −8.4 | −7.7 | −7.6 | −8.2 |
| 0.1 | — | 0.5 | 0.1 | 0.01 | 0.01 | — | 8 | 13 | 16 | −9.5 | −9.0 | −8.2 | −7.5 | −7.4 | −8.0 |
| 0.1 | — | 3.0 | 0.1 | 0.01 | 0.01 | — | 8 | 12 | 17 | −8.7 | −8.5 | −7.9 | −7.3 | −7.2 | −7.9 |
| 0.5 | — | 0.1 | 0.5 | .5 | 0.5 | — | 13 | 13 | 17 | −8.5 | −8.17 | −7.5 | −7.2 | −6.9 | −7.4 |
| 0.5 | — | 0.5 | 0.5 | 0.5 | 0.5 | — | 17 | 19 | 19 | −6.2 | −6.3 | −4.6 | −4.1 | −4.0 | −4.5 |
| 0.5 | — | 3.0 | 0.5 | 0.5 | 0.5 | — | 29 | 15 | 17 | −7.9 | −8.3 | −8.9 | −7.0 | −6.5 | −7.4 |
| 5.0 | — | 0.1 | 3.0 | 5.0 | 5.0 | — | 35 | 16 | 17 | −8.2 | −8.6 | −7.5 | −8.3 | −8.2 | −8.9 |

Table 2-continued

| Additives (mole %) | | | | | | | Characteristics of Resultant Resistor | | | Change Rate after Impulse Test(%) | | | Change Rate after D.C. Load Life Test(%) | | |
|---|---|---|---|---|---|---|---|---|---|---|---|---|---|---|---|
| $Bi_2O_3$ | CoO | MnO | $TiO_2$ | $Al_2O_3$ | $Ga_2O_3$ | $In_2O_3$ | C (V) at 10mA | $n_1$ | $n_2$ | ΔC at 1mA | $\Delta n_1$ | $\Delta n_2$ | ΔC at 10mA | $\Delta n_1$ | $\Delta n_2$ |
| 5.0 | — | 0.5 | 3.0 | 5.0 | 5.0 | — | 42 | 15 | 17 | −8.8 | −8.8 | −7.4 | −8.1 | −8.2 | −9.1 |
| 5.0 | — | 3.0 | 3.0 | 5.0 | 5.0 | — | 67 | 14 | 16 | −9.4 | −9.2 | −8.2 | −9.4 | −9.5 | −9.6 |
| 0.1 | 0.1 | 0.1 | 0.1 | 0.01 | 0.01 | — | 10 | 28 | 21 | +4.8 | −4.7 | −3.7 | −4.0 | −4.9 | −4.1 |
| 0.1 | 0.5 | 0.1 | 0.1 | 0.01 | 0.01 | — | 13 | 22 | 21 | +4.1 | −4.2 | −3.6 | −4.5 | −4.8 | −4.2 |
| 0.1 | 3.0 | 0.1 | 0.1 | 0.01 | 0.01 | — | 19 | 23 | 21 | +3.9 | −3.9 | −3.2 | −3.3 | −4.8 | −4.4 |
| 0.5 | 0.1 | 0.5 | 0.5 | 0.5 | 0.5 | — | 15 | 23 | 21 | +3.8 | −4.0 | −3.3 | −3.4 | −4.1 | −4.0 |
| 0.5 | 0.5 | 0.5 | 0.5 | 0.5 | 0.5 | — | 19 | 30 | 24 | +2.7 | −2.4 | −1.9 | −1.8 | −2.4 | −2.1 |
| 0.5 | 3.0 | 0.5 | 0.5 | 0.5 | 0.5 | — | 22 | 25 | 21 | +3.6 | −3.7 | −3.5 | −3.7 | −3.6 | −3.5 |
| 5.0 | 0.1 | 3.0 | 3.0 | 5.0 | 5.0 | — | 33 | 25 | 21 | +3.9 | −3.9 | −3.8 | −3.6 | −4.5 | −4.0 |
| 5.0 | 0.5 | 3.0 | 3.0 | 5.0 | 5.0 | — | 40 | 25 | 22 | +4.3 | −4.3 | −3.9 | −2.9 | −3.9 | −4.0 |
| 5.0 | 3.0 | 3.0 | 3.0 | 5.0 | 5.0 | — | 65 | 26 | 22 | +4.7 | −4.5 | −4.9 | −3.6 | −4.4 | −3.9 |
| 0.1 | 3.0 | 3.0 | 0.1 | 0.01 | 0.01 | — | 70 | 26 | 22 | +4.9 | −4.9 | −4.3 | −3.5 | −4.5 | −4.1 |
| 5.0 | 0.1 | 0.1 | 3.0 | 5.0 | 5.0 | — | 42 | 24 | 21 | +5.0 | −4.8 | −4.2 | −3.7 | −4.7 | −4.2 |
| 0.1 | 0.1 | — | 0.1 | — | 0.01 | 0.01 | 9 | 11 | 16 | +9.5 | −9.8 | −9.9 | −9.6 | −9.2 | −8.4 |
| 0.5 | 0.1 | — | 0.5 | — | 0.5 | 0.5 | 11 | 11 | 16 | +8.4 | −9.1 | −9.0 | −8.7 | −8.1 | −9.2 |
| 0.5 | 0.5 | — | 0.5 | — | 0.5 | 0.5 | 16 | 15 | 19 | +5.2 | −5.4 | −5.5 | −4.2 | −3.9 | −5.2 |
| 0.5 | 3.0 | — | 0.5 | — | 0.5 | 0.5 | 38 | 12 | 16 | +7.6 | −8.1 | −8.0 | −7.0 | −8.5 | −7.2 |
| 5.0 | 3.0 | — | 3.0 | — | 5.0 | 5.0 | 65 | 12 | 17 | +8.3 | −7.6 | −7.6 | −8.8 | −9.6 | −7.6 |
| 0.1 | — | 0.1 | 0.1 | — | 0.01 | 0.01 | 7 | 11 | 17 | +9.2 | −9.0 | −9.2 | −9.5 | −8.5 | −9.4 |
| 0.5 | — | 0.1 | 0.5 | — | 0.5 | 0.5 | 11 | 13 | 17 | +8.6 | −8.4 | −8.4 | −7.5 | −9.1 | −7.2 |
| 0.5 | — | 0.5 | 0.5 | — | 0.5 | 0.5 | 10 | 18 | 19 | +5.2 | −5.1 | −5.0 | −3.7 | −5.5 | −3.6 |
| 0.5 | — | 3.0 | 0.5 | — | 0.5 | 0.5 | 40 | 15 | 17 | +8.4 | −8.2 | −8.3 | −8.7 | −8.7 | −8.1 |
| 5.0 | — | 3.0 | 3.0 | — | 5.0 | 5.0 | 69 | 14 | 17 | +8.9 | −8.5 | −8.8 | −9.5 | −9.3 | −9.5 |
| 0.1 | 0.1 | 0.1 | 0.1 | — | 0.01 | 0.01 | 10 | 20 | 20 | +4.4 | −4.1 | −4.2 | −2.0 | −3.0 | −2.9 |
| 0.5 | 0.1 | 3.0 | 0.5 | — | 0.5 | 0.5 | 17 | 22 | 22 | +3.7 | −3.4 | −3.8 | −2.8 | −2.8 | −2.8 |
| 0.5 | 3.0 | 0.1 | 0.5 | — | 0.5 | 0.5 | 38 | 25 | 22 | +3.5 | −3.1 | −3.5 | −2.9 | −2.6 | −2.6 |
| 0.5 | 3.0 | 3.0 | 0.5 | — | 0.5 | 0.5 | 53 | 25 | 22 | +3.8 | −3.5 | −3.9 | −2.2 | −2.4 | −2.4 |
| 0.5 | 0.5 | 0.5 | 0.5 | — | 0.5 | 0.5 | 19 | 30 | 24 | +2.2 | −2.0 | −2.1 | −1.1 | −1.5 | −1.2 |
| 5.0 | 3.0 | 3.0 | 3.0 | — | 5.0 | 5.0 | 72 | 26 | 21 | +4.4 | −4.4 | −4.4 | −2.4 | −3.1 | −2.7 |
| 0.1 | 0.1 | — | 0.1 | 0.01 | 0.01 | 0.01 | 8 | 11 | 16 | +9.2 | −9.3 | −9.7 | −9.4 | −8.5 | −8.8 |
| 0.5 | 0.1 | — | 0.5 | 0.5 | 0.5 | 0.5 | 12 | 11 | 16 | +8.7 | −9.2 | −9.4 | −7.6 | −9.1 | −7.4 |
| 0.5 | 0.5 | — | 0.5 | 0.5 | 0.5 | 0.5 | 17 | 17 | 19 | +5.1 | −5.6 | −5.5 | −4.0 | −5.7 | −5.4 |
| 0.5 | 3.0 | — | 0.5 | 0.5 | 0.5 | 0.5 | 40 | 14 | 17 | +8.9 | −9.2 | −9.4 | −6.2 | −8.3 | −7.5 |
| 5.0 | 3.0 | — | 3.0 | 5.0 | 5.0 | 5.0 | 65 | 13 | 16 | +9.5 | −9.6 | −9.5 | −8.5 | −9.7 | −8.0 |
| 0.1 | — | 0.1 | 0.1 | 0.1 | 0.01 | 0.01 | 16 | 12 | 20 | −9.3 | −9.2 | −9.7 | −8.9 | −9.4 | −8.9 |
| 0.5 | — | 0.1 | 0.5 | 0.5 | 0.5 | 0.5 | 22 | 12 | 21 | −8.9 | −9.3 | −9.3 | −7.1 | −7.6 | −6.8 |
| 0.5 | — | 0.5 | 0.5 | 0.5 | 0.5 | 0.5 | 18 | 18 | 24 | −5.1 | −5.5 | −5.1 | −3.7 | −3.6 | −3.4 |
| 0.5 | — | 3.0 | 0.5 | 0.5 | 0.5 | 0.5 | 40 | 11 | 21 | −8.09 | −9.3 | −9.4 | −8.5 | −8.4 | −8.4 |
| 5.0 | — | 3.0 | 3.0 | 5.0 | 5.0 | 5.0 | 63 | 12 | 22 | −9.4 | −9.5 | −9.6 | −9.2 | −9.7 | −9.0 |
| 0.1 | 0.1 | 0.1 | 0.1 | 0.01 | 0.01 | 0.01 | 9 | 20 | 20 | +4.8 | −4.7 | −4.6 | −3.0 | −2.8 | −2.8 |
| 0.5 | 0.1 | 3.0 | 0.5 | 0.5 | 0.5 | 0.5 | 21 | 22 | 22 | +3.9 | −4.1 | −4.1 | −2.9 | −2.6 | −2.9 |
| 0.5 | 3.0 | 0.1 | 0.5 | 0.5 | 0.5 | 0.5 | 20 | 23 | 22 | +3.3 | −3.3 | −3.9 | −2.4 | −2.5 | −2.5 |
| 0.5 | 3.0 | 3.0 | 0.5 | 0.5 | 0.5 | 0.5 | 24 | 25 | 21 | +3.4 | −3.6 | −3.9 | −2.2 | −2.4 | −2.9 |
| 0.5 | 0.5 | 0.5 | 0.5 | 0.5 | 0.5 | 0.5 | 35 | 30 | 24 | +2.1 | −2.2 | −2.5 | −0.8 | −0.5 | −1.1 |
| 5.0 | 3.0 | 3.0 | 3.0 | 5.0 | 5.0 | 5.0 | 58 | 25 | 20 | +4.8 | −4.1 | −4.0 | −2.9 | −2.2 | −2.4 |

Table 3

| Additives (mole %) | | | | | | | | | Characteristics of Resultant Resistor | | | Change Rate after Impulse Test (%) | | | Change Rate after D.C. Load Life Test (%) | | |
|---|---|---|---|---|---|---|---|---|---|---|---|---|---|---|---|---|---|
| $Bi_2O_3$ | CoO | MnO | $TiO_2$ | NiO | $Cr_2O_3$ | $Al_2O_3$ | $Ga_2O_3$ | $In_2O_3$ | C(V) at 10 mA | $n_1$ | $n_2$ | Δ C at 1 mA | Δ $n_1$ | Δ $n_2$ | Δ C at 10 mA | Δ $n_1$ | Δ $n_2$ |
| 0.1 | 0.1 | 0.1 | 0.1 | 0.1 | — | — | 0.01 | — | 12 | 35 | 27 | +4.6 | +0.5 | +0.1 | −1.8 | +0.5 | +0.8 |
| 0.1 | 0.1 | 0.1 | 0.1 | 0.1 | — | — | 0.5 | — | 24 | 36 | 27 | +4.0 | +1.2 | +0.5 | −1.4 | +0.8 | +1.0 |
| 0.1 | 0.1 | 0.1 | 0.1 | 0.1 | — | — | 0.5 | — | 51 | 36 | 26 | +4.8 | +1.0 | +0.4 | −1.7 | +0.8 | +1.1 |
| 0.5 | 0.5 | 0.5 | 0.5 | 0.5 | — | — | 0.01 | — | 19 | 36 | 30 | +4.0 | +2.3 | +1.2 | −0.6 | +2.1 | +2.6 |
| 0.5 | 0.5 | 0.5 | 0.5 | 0.5 | — | — | 0.5 | — | 30 | 38 | 31 | +2.5 | +2.4 | +1.8 | −0.5 | +2.5 | +3.1 |
| 0.5 | 0.5 | 0.5 | 0.5 | 0.5 | — | — | 5.0 | — | 70 | 37 | 30 | +3.2 | +2.1 | +1.3 | −0.6 | +2.2 | +2.1 |
| 5.0 | 3.0 | 3.0 | 3.0 | 5.0 | — | — | 0.01 | — | 34 | 35 | 25 | +4.0 | +0.8 | +0.2 | −1.4 | +1.0 | +1.0 |
| 5.0 | 3.0 | 3.0 | 3.0 | 5.0 | — | — | 0.5 | — | 54 | 37 | 27 | +4.5 | +1.2 | +0.3 | −1.9 | +0.7 | +0.7 |
| 5.0 | 3.0 | 3.0 | 3.0 | 5.0 | — | — | 5.0 | — | 77 | 37 | 27 | +4.9 | +1.3 | +0.4 | −1.7 | +0.6 | +0.5 |
| 0.1 | 0.1 | 0.1 | 0.1 | 0.01 | — | 0.01 | 0.01 | — | 20 | 35 | 27 | +5.4 | +0.7 | +0.2 | −1.3 | +0.7 | +0.9 |
| 0.1 | 0.1 | 0.1 | 0.1 | 0.01 | — | 0.5 | 0.5 | — | 31 | 36 | 27 | ±5.6 | +0.8 | +0.4 | −1.6 | +0.9 | +1.1 |
| 0.1 | 0.1 | 0.1 | 0.1 | 0.01 | — | 5.0 | 5.0 | — | 41 | 36 | 26 | +5.9 | +1.1 | +0.4 | −1.8 | +1.0 | +1.2 |
| 0.5 | 0.5 | 0.5 | 0.5 | 0.5 | — | 0.01 | 0.01 | — | 27 | 37 | 30 | +3.9 | +2.3 | +1.3 | −0.6 | +2.4 | +2.7 |
| 0.5 | 0.5 | 0.5 | 0.5 | 0.5 | — | 0.5 | 0.5 | — | 34 | 38 | 31 | +4.2 | +2.5 | +1.5 | −0.5 | +2.9 | +3.1 |
| 0.5 | 0.5 | 0.5 | 0.5 | 0.5 | — | 5.0 | 5.0 | — | 74 | 37 | 30 | +5.1 | +2.9 | +1.2 | −0.6 | +2.5 | +2.3 |
| 5.0 | 3.0 | 3.0 | 3.0 | 5.0 | — | 0.01 | 0.01 | — | 37 | 37 | 25 | +5.3 | +1.2 | +0.7 | −1.8 | +1.2 | +1.0 |
| 5.0 | 3.0 | 3.0 | 3.0 | 5.0 | — | 0.5 | 0.5 | — | 54 | 37 | 26 | +5.7 | +1.5 | +0.5 | −1.9 | +0.9 | +0.8 |
| 5.0 | 3.0 | 3.0 | 3.0 | 5.0 | — | 5.0 | 5.0 | — | 78 | 36 | 26 | +5.5 | +1.8 | +0.3 | −1.6 | +0.8 | +0.5 |
| 0.1 | 0.1 | 0.1 | 0.1 | 0.01 | — | — | 0.01 | 0.01 | 16 | 36 | 25 | +3.8 | +1.2 | +1.0 | −1.2 | +0.2 | +0.6 |
| 0.1 | 0.1 | 0.1 | 0.1 | 0.01 | — | — | 0.5 | 0.5 | 36 | 37 | 26 | +3.9 | +1.2 | +1.5 | −0.8 | +0.5 | +0.4 |
| 0.1 | 0.1 | 0.1 | 0.1 | 0.01 | — | — | 5.0 | 5.0 | 60 | 37 | 25 | +4.1 | +1.1 | +1.8 | −1.5 | +0.4 | +0.3 |
| 0.5 | 0.5 | 0.5 | 0.5 | 0.5 | — | — | 0.01 | 0.01 | 30 | 40 | 31 | +2.2 | +4.2 | +4.3 | −0.6 | +0.1 | +1.1 |
| 0.5 | 0.5 | 0.5 | 0.5 | 0.5 | — | — | 0.5 | 0.5 | 31 | 43 | 32 | +1.4 | +4.5 | +4.4 | −0.4 | +1.2 | +1.4 |
| 0.5 | 0.5 | 0.5 | 0.5 | 0.5 | — | — | 5.0 | 5.0 | 71 | 39 | 31 | +1.9 | +4.0 | +4.0 | −0.6 | +0.1 | +1.2 |
| 5.0 | 3.0 | 3.0 | 3.0 | 5.0 | — | — | 0.01 | 0.01 | 39 | 37 | 27 | +3.9 | +1.4 | +2.1 | −0.9 | +0.5 | +0.5 |
| 5.0 | 3.0 | 3.0 | 3.0 | 5.0 | — | — | 0.5 | 0.5 | 49 | 38 | 27 | +2.8 | +1.5 | +1.9 | −1.2 | +0.6 | +0.4 |
| 5.0 | 3.0 | 3.0 | 3.0 | 5.0 | — | — | 5.0 | 5.0 | 75 | 37 | 27 | +4.3 | +1.7 | +1.7 | −1.1 | +0.9 | +0.6 |
| 0.1 | 0.1 | 0.1 | 0.1 | 0.1 | — | 0.01 | 0.01 | 0.01 | 14 | 34 | 26 | +4.3 | +0.6 | +0.3 | −1.4 | +0.5 | +0.4 |
| 0.1 | 0.1 | 0.1 | 0.1 | 0.1 | — | 0.5 | 0.5 | 0.5 | 25 | 35 | 26 | +4.7 | +1.4 | +0.6 | −1.7 | +0.4 | +0.9 |
| 0.1 | 0.1 | 0.1 | 0.1 | 0.1 | — | 5.0 | 5.0 | 5.0 | 53 | 36 | 25 | +4.8 | +0.8 | +0.4 | −1.5 | +0.5 | +1.1 |
| 0.5 | 0.5 | 0.5 | 0.5 | 0.5 | — | 0.01 | 0.01 | 0.01 | 21 | 35 | 29 | +4.0 | +2.1 | +1.4 | −0.3 | +2.3 | +2.6 |

Table 3-continued

| Additives (mole %) | | | | | | | | | Characteristics of Resultant Resistor | | | Change Rate after Impulse Test (%) | | | Change Rate after D.C. Load Life Test (%) | | |
|---|---|---|---|---|---|---|---|---|---|---|---|---|---|---|---|---|---|
| $Bi_2O_3$ | CoO | MnO | $TiO_2$ | NiO | $Cr_2O_3$ | $Al_2O_3$ | $Ga_2O_3$ | $In_2O_3$ | C(V) at 10 mA | $n_1$ | $n_2$ | Δ C at 1 mA | Δ $n_1$ | Δ $n_2$ | Δ C at 10 mA | Δ $n_1$ | Δ $n_2$ |
| 0.5 | 0.5 | 0.5 | 0.5 | 0.5 | — | 0.5 | 0.5 | 0.5 | 33 | 38 | 30 | +3.7 | +2.4 | +1.9 | −0.1 | +2.8 | +3.1 |
| 0.5 | 0.5 | 0.5 | 0.5 | 0.5 | — | 5.0 | 5.0 | 5.0 | 72 | 37 | 28 | +4.4 | +2.1 | +1.3 | −0.2 | +2.0 | +2.3 |
| 5.0 | 3.0 | 3.0 | 3.0 | 5.0 | — | 0.01 | 0.01 | 0.01 | 35 | 36 | 26 | +4.5 | +1.0 | +0.7 | −1.4 | +1.1 | +1.0 |
| 5.0 | 3.0 | 3.0 | 3.0 | 5.0 | — | 0.5 | 0.5 | 0.5 | 55 | 36 | 26 | +5.2 | +1.3 | +0.7 | −1.7 | +0.9 | +0.8 |
| 5.0 | 3.0 | 3.0 | 3.0 | 5.0 | — | 5.0 | 5.0 | 5.0 | 79 | 35 | 27 | +4.9 | +1.0 | +0.6 | −1.4 | +0.8 | +0.3 |
| 0.1 | 0.1 | 0.1 | 0.1 | — | 0.01 | — | 0.01 | — | 16 | 35 | 25 | +4.4 | +0.4 | +0.1 | −1.5 | +0.6 | +0.8 |
| 0.1 | 0.1 | 0.1 | 0.1 | — | 0.01 | — | 0.5 | — | 37 | 36 | 26 | +3.8 | +1.1 | +0.4 | −1.5 | +0.9 | +1.0 |
| 0.1 | 0.1 | 0.1 | 0.1 | — | 0.01 | — | 5.0 | — | 62 | 35 | 25 | +4.6 | +0.9 | +0.3 | −1.6 | +0.8 | +1.1 |
| 0.5 | 0.5 | 0.5 | 0.5 | — | 0.5 | — | 0.01 | — | 30 | 36 | 30 | +3.8 | +2.2 | +1.2 | −0.8 | +2.3 | +2.5 |
| 0.5 | 0.5 | 0.5 | 0.5 | — | 0.5 | — | 0.5 | — | 33 | 38 | 32 | +2.2 | +2.4 | +1.8 | −0.5 | +2.7 | +3.0 |
| 0.5 | 0.5 | 0.5 | 0.5 | — | 0.5 | — | 5.0 | — | 74 | 35 | 30 | +3.0 | +2.0 | +1.2 | −0.9 | +2.5 | +2.2 |
| 5.0 | 3.0 | 3.0 | 3.0 | — | 5.0 | — | 0.01 | — | 40 | 35 | 29 | +3.7 | +0.7 | +0.5 | −1.5 | +1.1 | +1.0 |
| 5.0 | 3.0 | 3.0 | 3.0 | — | 5.0 | — | 0.5 | — | 51 | 34 | 27 | +4.3 | +1.1 | +0.7 | −2.1 | +0.6 | +0.6 |
| 5.0 | 3.0 | 3.0 | 3.0 | — | 5.0 | — | 5.0 | — | 76 | 35 | 25 | +4.5 | +1.3 | +0.8 | −1.8 | +0.4 | +0.2 |
| 0.1 | 0.1 | 0.1 | 0.1 | — | 0.01 | 0.01 | 0.01 | — | 19 | 36 | 26 | +4.4 | +1.7 | +1.1 | −0.3 | +0.9 | +1.9 |
| 0.1 | 0.1 | 0.1 | 0.1 | — | 0.01 | 0.5 | 0.5 | — | 33 | 37 | 27 | +4.6 | +1.8 | +1.4 | −0.6 | +1.1 | +2.1 |
| 0.1 | 0.1 | 0.1 | 0.1 | — | 0.01 | 5.0 | 5.0 | — | 76 | 36 | 27 | +4.9 | +2.1 | +1.4 | −0.8 | +1.2 | +2.0 |
| 0.5 | 0.5 | 0.5 | 0.5 | — | 0.5 | 0.01 | 0.01 | — | 22 | 36 | 30 | +2.7 | +2.3 | +2.3 | +0.1 | +2.5 | +3.7 |
| 0.5 | 0.5 | 0.5 | 0.5 | — | 0.5 | 0.5 | 0.5 | — | 37 | 40 | 35 | +3.2 | +3.5 | +2.4 | ±0 | +3.3 | +4.5 |
| 0.5 | 0.5 | 0.5 | 0.5 | — | 0.5 | 5.0 | 5.0 | — | 78 | 36 | 31 | +4.1 | +3.9 | +2.3 | +0.1 | +3.0 | +3.3 |
| 5.0 | 3.0 | 3.0 | 3.0 | — | 5.0 | 0.01 | 0.01 | — | 39 | 36 | 29 | +4.3 | +2.2 | +1.5 | −0.8 | +3.2 | +2.1 |
| 5.0 | 3.0 | 3.0 | 3.0 | — | 5.0 | 0.5 | 0.5 | — | 52 | 35 | 28 | +4.7 | +2.5 | +1.3 | −0.9 | +1.9 | +1.8 |
| 5.0 | 3.0 | 3.0 | 3.0 | — | 5.0 | 5.0 | 5.0 | — | 80 | 35 | 27 | +4.5 | +2.8 | +1.1 | −0.6 | +1.8 | +0.9 |
| 0.1 | 0.1 | 0.1 | 0.1 | — | 0.01 | — | 0.01 | 0.01 | 18 | 37 | 26 | +3.9 | +1.5 | +1.1 | −1.1 | +0.3 | +0.5 |
| 0.1 | 0.1 | 0.1 | 0.1 | — | 0.01 | — | 0.5 | 0.5 | 39 | 38 | 27 | +3.7 | +1.6 | +1.6 | −0.7 | −0.6 | +0.4 |
| 0.1 | 0.1 | 0.1 | 0.1 | — | 0.01 | — | 5.0 | 5.0 | 63 | 37 | 26 | +3.7 | +1.3 | +1.9 | −1.4 | +0.5 | +0.2 |
| 0.5 | 0.5 | 0.5 | 0.5 | — | 0.5 | — | 0.01 | 0.01 | 32 | 38 | 27 | +1.2 | +4.4 | +4.4 | −0.5 | +0.1 | +0.7 |
| 0.5 | 0.5 | 0.5 | 0.5 | — | 0.5 | — | 0.5 | 0.5 | 35 | 41 | 35 | +1.1 | +4.7 | +4.3 | −0.3 | +2.3 | +1.9 |
| 0.5 | 0.5 | 0.5 | 0.5 | — | 0.5 | — | 5.0 | 5.0 | 76 | 39 | 29 | +1.7 | +4.1 | +4.1 | −0.6 | +1.1 | +1.1 |
| 5.0 | 3.0 | 3.0 | 3.0 | — | 5.0 | — | 0.01 | 0.01 | 41 | 36 | 27 | +2.8 | +1.8 | +2.0 | −0.8 | +0.6 | +0.7 |
| 5.0 | 3.0 | 3.0 | 3.0 | — | 5.0 | — | 0.5 | 0.5 | 53 | 35 | 28 | +1.8 | +1.8 | +1.7 | −1.4 | +0.6 | +0.5 |
| 5.0 | 3.0 | 3.0 | 3.0 | — | 5.0 | — | 5.0 | 5.0 | 78 | 37 | 28 | +3.1 | +1.9 | +1.5 | −1.2 | +1.2 | +0.9 |
| 0.1 | 0.1 | 0.1 | 0.1 | — | 0.01 | 0.01 | 0.01 | 0.01 | 24 | 37 | 26 | +4.2 | +0.6 | +0.4 | −1.4 | +0.7 | +1.6 |
| 0.1 | 0.1 | 0.1 | 0.1 | — | 0.01 | 0.5 | 0.5 | 0.5 | 40 | 38 | 27 | +4.5 | +1.5 | +0.7 | −1.6 | +0.6 | +1.5 |
| 0.1 | 0.1 | 0.1 | 0.1 | — | 0.01 | 5.0 | 5.0 | 5.0 | 47 | 38 | 27 | +4.4 | +1.8 | +0.6 | −1.4 | +0.5 | +1.4 |
| 0.5 | 0.5 | 0.5 | 0.5 | — | 0.5 | 0.01 | 0.01 | 0.01 | 35 | 38 | 27 | +3.0 | +3.1 | +2.4 | −0.1 | +2.4 | +2.2 |
| 0.5 | 0.5 | 0.5 | 0.5 | — | 0.5 | 0.5 | 0.5 | 0.5 | 46 | 42 | 35 | +2.7 | +3.4 | +2.9 | +0.5 | +2.9 | +3.5 |
| 0.5 | 0.5 | 0.5 | 0.5 | — | 0.5 | 5.0 | 5.0 | 5.0 | 77 | 38 | 27 | +3.4 | +3.0 | +2.0 | −0.2 | +2.0 | +2.3 |
| 5.0 | 3.0 | 3.0 | 3.0 | — | 5.0 | 0.01 | 0.01 | 0.01 | 47 | 37 | 28 | +4.1 | +2.0 | +1.7 | −1.4 | +1.1 | +1.6 |
| 5.0 | 3.0 | 3.0 | 3.0 | — | 5.0 | 0.5 | 0.5 | 0.5 | 62 | 37 | 29 | +4.8 | +1.8 | [illegible] | −1.7 | +1.2 | +1.5 |
| 5.0 | 3.0 | 3.0 | 3.0 | — | 5.0 | 5.0 | 5.0 | 5.0 | 68 | 35 | 29 | +4.6 | +1.2 | +0.6 | −1.5 | +1.8 | +1.7 |
| 0.1 | 0.1 | 0.1 | 0.1 | 0.01 | 0.01 | — | 0.01 | — | 14 | 36 | 29 | +2.9 | +2.5 | +3.1 | −0.1 | +2.3 | +4.5 |
| 0.1 | 0.1 | 0.1 | 0.1 | 0.1 | 0.01 | — | 0.5 | — | 26 | 37 | 29 | +2.7 | +2.6 | +3.6 | −0.7 | +2.6 | +4.4 |
| 0.1 | 0.1 | 0.1 | 0.1 | 0.1 | 0.01 | — | 5.0 | — | 53 | 37 | 28 | +2.8 | +3.3 | +3.9 | −0.4 | +2.5 | +4.2 |
| 0.5 | 0.5 | 0.5 | 0.5 | 0.5 | 0.5 | — | 0.01 | — | 21 | 37 | 30 | +0.1 | +4.4 | +6.4 | +0.1 | +3.1 | +5.7 |
| 0.5 | 0.5 | 0.5 | 0.5 | 0.5 | 0.5 | — | 0.5 | — | 34 | 40 | 35 | +0.1 | +4.7 | +6.3 | +0.2 | +4.3 | +6.9 |
| 0.5 | 0.5 | 0.5 | 0.5 | 0.5 | 0.5 | — | 5.0 | — | 72 | 38 | 30 | +0.7 | +4.1 | +6.1 | +0.1 | +3.1 | +5.1 |
| 5.0 | 3.0 | 3.0 | 3.0 | 5.0 | 5.0 | — | 0.01 | — | 36 | 37 | 27 | +1.8 | +2.8 | +3.0 | +0.4 | +2.6 | +4.7 |
| 5.0 | 3.0 | 3.0 | 3.0 | 5.0 | 5.0 | — | 0.5 | — | 55 | 37 | 28 | +1.8 | +2.9 | +2.7 | +0.9 | +2.6 | +3.5 |
| 5.0 | 3.0 | 3.0 | 3.0 | 5.0 | 5.0 | — | 5.0 | — | 77 | 35 | 28 | +2.1 | +2.9 | +2.5 | +0.7 | +3.2 | +2.9 |
| 0.1 | 0.1 | 0.1 | 0.1 | 0.1 | 0.01 | 0.01 | 0.01 | — | 23 | 36 | 28 | +2.8 | +3.3 | +2.0 | −0.3 | +2.5 | +2.4 |
| 0.1 | 0.1 | 0.1 | 0.1 | 0.1 | 0.01 | 0.5 | 0.5 | — | 34 | 35 | 28 | +2.9 | +3.2 | +3.6 | −0.6 | +2.4 | +2.9 |
| 0.1 | 0.1 | 0.1 | 0.1 | 0.1 | 0.01 | 5.0 | 5.0 | — | 42 | 35 | 27 | +2.9 | +3.1 | +3.9 | −1.4 | +2.5 | +3.1 |
| 0.5 | 0.5 | 0.5 | 0.5 | 0.5 | 0.5 | 0.01 | 0.01 | — | 31 | 38 | 31 | +1.0 | +4.3 | +4.4 | −0.2 | +4.3 | +3.6 |
| 0.5 | 0.5 | 0.5 | 0.5 | 0.5 | 0.5 | 0.5 | 0.5 | — | 36 | 41 | 35 | +0.2 | +4.6 | +4.5 | −0.1 | +4.8 | +4.1 |
| 0.5 | 0.5 | 0.5 | 0.5 | 0.5 | 5.0 | 5.0 | 5.0 | — | 75 | 39 | 32 | +0.6 | +4.1 | +4.0 | −0.1 | +4.0 | +3.3 |
| 5.0 | 3.0 | 3.0 | 3.0 | 5.0 | 5.0 | 0.01 | 0.01 | — | 39 | 38 | 27 | +2.7 | +3.5 | +4.2 | −1.5 | +3.1 | +3.0 |
| 5.0 | 3.0 | 3.0 | 3.0 | 5.0 | 5.0 | 0.5 | 0.5 | — | 58 | 37 | 26 | +1.8 | +2.6 | +4.0 | −0.7 | +2.9 | +2.8 |
| 5.0 | 3.0 | 3.0 | 3.0 | 5.0 | 5.0 | 5.0 | 5.0 | — | 75 | 38 | 27 | +3.1 | +3.7 | +3.9 | −0.8 | +2.8 | +2.3 |
| 0.1 | 0.1 | 0.1 | 0.1 | 0.1 | 0.01 | — | 0.01 | 0.01 | 18 | 37 | 26 | +3.4 | +1.4 | +1.1 | −0.5 | +1.6 | +1.8 |
| 0.1 | 0.1 | 0.1 | 0.1 | 0.1 | 0.01 | — | 0.5 | 0.5 | 37 | 38 | 27 | +2.8 | +2.1 | +1.4 | −0.5 | +1.9 | +2.0 |
| 0.1 | 0.1 | 0.1 | 0.1 | 0.1 | 0.01 | — | 5.0 | 5.0 | 62 | 38 | 26 | +3.6 | +1.9 | +1.3 | −0.6 | +1.8 | +2.1 |
| 0.5 | 0.5 | 0.5 | 0.5 | 0.5 | 0.5 | — | 0.01 | 0.01 | 31 | 41 | 31 | +2.8 | +3.2 | +2.3 | −0.3 | +3.3 | +3.5 |
| 0.5 | 0.5 | 0.5 | 0.5 | 0.5 | 0.5 | — | 0.5 | 0.5 | 33 | 44 | 34 | +1.2 | +3.4 | +2.8 | ±0 | +4.7 | +4.0 |
| 0.5 | 0.5 | 0.5 | 0.5 | 0.5 | 0.5 | — | 5.0 | 5.0 | 72 | 40 | 31 | +2.0 | +3.0 | +2.2 | −0.4 | +3.5 | +3.2 |
| 5.0 | 3.0 | 3.0 | 3.0 | 5.0 | 5.0 | — | 0.01 | 0.01 | 40 | 38 | 27 | +2.7 | +1.7 | +1.5 | −1.0 | +2.1 | +2.0 |
| 5.0 | 3.0 | 3.0 | 3.0 | 5.0 | 5.0 | — | 0.5 | 0.5 | 49 | 38 | 28 | +3.3 | +2.1 | +1.7 | −1.6 | +1.6 | +1.6 |
| 5.0 | 3.0 | 3.0 | 3.0 | 5.0 | 5.0 | — | 5.0 | 5.0 | 77 | 38 | 28 | +3.5 | +2.3 | +0.8 | −1.8 | +1.4 | +1.2 |
| 0.1 | 0.1 | 0.1 | 0.1 | 0.1 | 0.01 | 0.01 | 0.01 | 0.01 | 25 | 40 | 31 | +0.7 | +3.2 | +4.9 | +0.7 | +3.3 | +5.0 |
| 0.1 | 0.1 | 0.1 | 0.1 | 0.1 | 0.01 | 0.5 | 0.5 | 0.5 | 37 | 39 | 33 | +0.6 | +3.4 | +3.4 | +0.7 | +3.4 | +3.5 |
| 0.1 | 0.1 | 0.1 | 0.1 | 0.1 | 0.01 | 5.0 | 5.0 | 5.0 | 44 | 38 | 33 | +0.8 | +3.6 | +3.7 | +0.9 | +3.7 | +3.8 |
| 0.5 | 0.5 | 0.5 | 0.5 | 0.5 | 0.5 | 0.01 | 0.01 | 0.01 | 33 | 40 | 36 | +0.2 | +4.9 | +6.9 | +0.3 | +4.9 | +7.0 |
| 0.5 | 0.5 | 0.5 | 0.5 | 0.5 | 0.5 | 0.5 | 0.5 | 0.5 | 41 | 47 | 38 | +0.1 | +5.9 | +7.8 | +0.2 | +5.8 | +8.2 |
| 0.5 | 0.5 | 0.5 | 0.5 | 0.5 | 0.5 | 5.0 | 5.0 | 5.0 | 78 | 42 | 36 | +0.3 | +3.9 | +6.6 | +0.3 | +3.8 | +6.7 |
| 5.0 | 3.0 | 3.0 | 3.0 | 5.0 | 5.0 | 0.01 | 0.01 | 0.01 | 40 | 40 | 34 | +0.7 | +3.4 | +5.3 | +0.8 | +3.3 | +5.2 |
| 5.0 | 3.0 | 3.0 | 3.0 | 5.0 | 5.0 | 0.5 | 0.5 | 0.5 | 58 | 40 | 32 | +0.9 | +3.7 | +5.4 | +0.9 | +3.8 | +5.3 |
| 5.0 | 3.0 | 3.0 | 3.0 | 5.0 | 5.0 | 5.0 | 5.0 | 5.0 | 73 | 38 | 33 | +1.2 | +3.9 | +5.6 | +1.0 | +4.0 | +5.7 |

Table 4

| Sample No. | Heating Cycle Test (%) | | | Humidity Test (%) | | |
|---|---|---|---|---|---|---|
| | Δ C | Δ $n_1$ | Δ $n_2$ | Δ C | Δ $n_1$ | Δ $n_2$ |
| Example 1 | −3.4 to −5.7 | −3.8 to −6.5 | −3.1 to −6.2 | −3.3 to −5.8 | −3.5 to 6.8 | −2.9 to −6.5 |
| Example 2 | −2.1 to −2.82 | −2.0 to −3.9 | −2.4 to −2.9 | −2.0 to −2.5 | −3.1 to −2.7 | −2.0 to −2.7 |

Table 4-continued

| Sample No. | Heating Cycle Test (%) | | | Humidity Test (%) | | |
|---|---|---|---|---|---|---|
| | Δ C | Δ $n_1$ | Δ $n_2$ | Δ C | Δ $n_1$ | Δ $n_2$ |
| Example 3 | −0.2 to −0.9 | −0.1 to −0.8 | −0.2 to −0.8 | −0.5 to −1.7 | −0.4 to −1.9 | −0.2 to −1.8 |

What we claim is:

1. A voltage-dependent resistor of bulk-type comprising a sintered body consisting essentially of zinc oxide (ZnO), as a main constituent, and, as additives, 0.1 to 5.0 mole percent of bismuth oxide ($Bi_2O_3$), 0.01 to 5.0 mole percent of gallium oxide ($Ga_2O_3$), at least one member selected from the group consisting of 0.1 to 3.0 mole percent of cobalt oxide (CoO) and 0.1 to 3.0 mole percent of manganese oxide (MnO), and electrodes applied to opposite surfaces of said sintered body.

2. A voltage-dependent resistor according to claim 1, wherein said sintered body is of a composition consisting essentially of zinc oxide (ZnO), as a main constituent, and as additives, 0.1 to 5.0 mole percent of bismuth oxide ($Bi_2O_3$), 0.1 to 5.0 mole percent of gallium oxide ($Ga_2O_3$), at least one member selected from the group consisting of 0.1 to 3.0 mole percent of cobalt oxide (CoO) and 0.1 to 3.0 mole percent of manganese oxide (MnO), and further including at least one member selected from the group consisting of 0.01 to 5.0 mole percent of aluminum oxide ($Al_2O_3$) and 0.01 to 5.0 mole percent of indium oxide ($In_2O_3$).

3. A voltage-dependent resistor according to claim 1, wherein said sintered body is of a composition consisting essentially of zinc oxide (ZnO), as a main constituent, and as additives, 0.1 to 5.0 mole percent of bismuth oxide ($Bi_2O_3$), 0.01 to 5.0 mole percent of gallium oxide ($Ga_2O_3$), at least one member selected from the group consisting of 0.1 to 3.0 mole percent of cobalt oxide (CoO) and 0.1 to 3.0 mole percent of manganese oxide (MnO), and further including 0.1 to 3.0 mole percent of titanium oxide ($TiO_2$).

4. A voltage-dependent resistor according to claim 1, wherein said sintered body is of a composition consisting essentially of zinc oxide (ZnO), as a main constituent, and, as additives, 0.1 to 5.0 mole percent of bismuth oxide ($Bi_2O_3$), 0.01 to 5.0 mole percent of gallium oxide ($Ga_2O_3$), at least one member selected from the group consisting of 0.1 to 3.0 mole percent of cobalt oxide (CoO) and 0.1 to 3.0 mole percent of manganese oxide (MnO), and further including at least one member selected from the group consisting of 0.01 to 5.0 mole percent of aluminum oxide ($Al_2O_3$) and 0.01 to 5.0 mole percent of indium oxide ($In_2O_3$) and 0.1 to 3.0 mole percent of titanium oxide ($TiO_2$).

5. A voltage-dependent resistor according to claim 1 wherein said sintered body is of a composition consisting essentially of zinc oxide (ZnO), as a main constituent, and, as additives, 0.1 to 5.0 mole percent of bismuth oxide ($Bi_2O_3$), 0.01 to 5.0 mole percent of gallium oxide ($Ga_2O_3$), at least one member selected from the group consisting of 0.1 to 3.0 mole percent of cobalt oxide (CoO) and 0.1 to 3.0 mole percent of manganese oxide (MnO), and further including 0.1 to 3.0 mole percent of titanium oxide and at least one member selected from the group consisting of 0.1 to 5.0 mole percent of nickel oxide (NiO) and 0.01 to 5.0 mole percent of chromium oxide ($Cr_2O_3$).

6. A voltage-dependent resistor according to claim 1, wherein said sintered body is of a composition consisting essentially of zinc oxide (ZnO), as a main constituent, and, as additives, 0.1 to 5.0 mole percent of bismuth oxide ($Bi_2O_3$), 0.01 to 5.0 mole percent of gallium oxide ($Ga_2O_3$), at least one member selected from the group consisting of 0.1 to 3.0 mole percent of cobalt oxide (CoO) and 0.1 to 3.0 mole percent of manganese oxide (MnO), and further including at least one member selected from the group consisting of 0.01 to 5.0 mole percent of aluminum oxide ($Al_2O_3$) and 0.01 to 5.0 mole percent of indium oxide ($In_2O_3$), 0.1 to 3.0 mole percent of titanium oxide ($TiO_2$) and at least one member selected from the group consisting of 0.1 to 5.0 mole percent of nickel oxide (NiO) and 0.01 to 5.0 mole percent of chromium oxide ($Cr_2O_3$).

* * * * *